United States Patent [19]

Zettergren

[11] 3,943,973

[45] Mar. 16, 1976

[54] CONTROL SYSTEM

[75] Inventor: Ted Zettergren, Lundevarv, Sweden

[73] Assignee: Tedeco AG, Zug, Switzerland

[22] Filed: Mar. 21, 1975

[21] Appl. No.: 560,932

[30] Foreign Application Priority Data

Mar. 22, 1974 Sweden ..... 7403901

[52] U.S. Cl. ..... 137/624.15; 91/414; 137/596.16; 340/147 MT

[51] Int. Cl.[2] ..... F15B 13/06

[58] Field of Search ..... 91/414, 459; 137/596.16, 137/635, 637, 624.15; 328/70, 75, 106; 340/147 MT, 167 A, 167 B

[56] References Cited

UNITED STATES PATENTS 3,822,723 7/1974 Crowell ..... 137/624.15

*Primary Examiner*—Alan Cohan
*Assistant Examiner*—Gerald A. Michalsky
*Attorney, Agent, or Firm*—Larson, Taylor & Hinds

[57] ABSTRACT

A control system for remote proportional positioning of hydraulic directional control valves includes pulse duration modulation control of electrohydraulic converters controlling hydraulic valve spool positioners. Pulse groups supplied to the converters have a repetition rate of the order of 50 Hz to cause mechanical vibrations in the hydraulic liquid and the valve positioners, thereby reducing frictional hysteresis.

3 Claims, 1 Drawing Figure

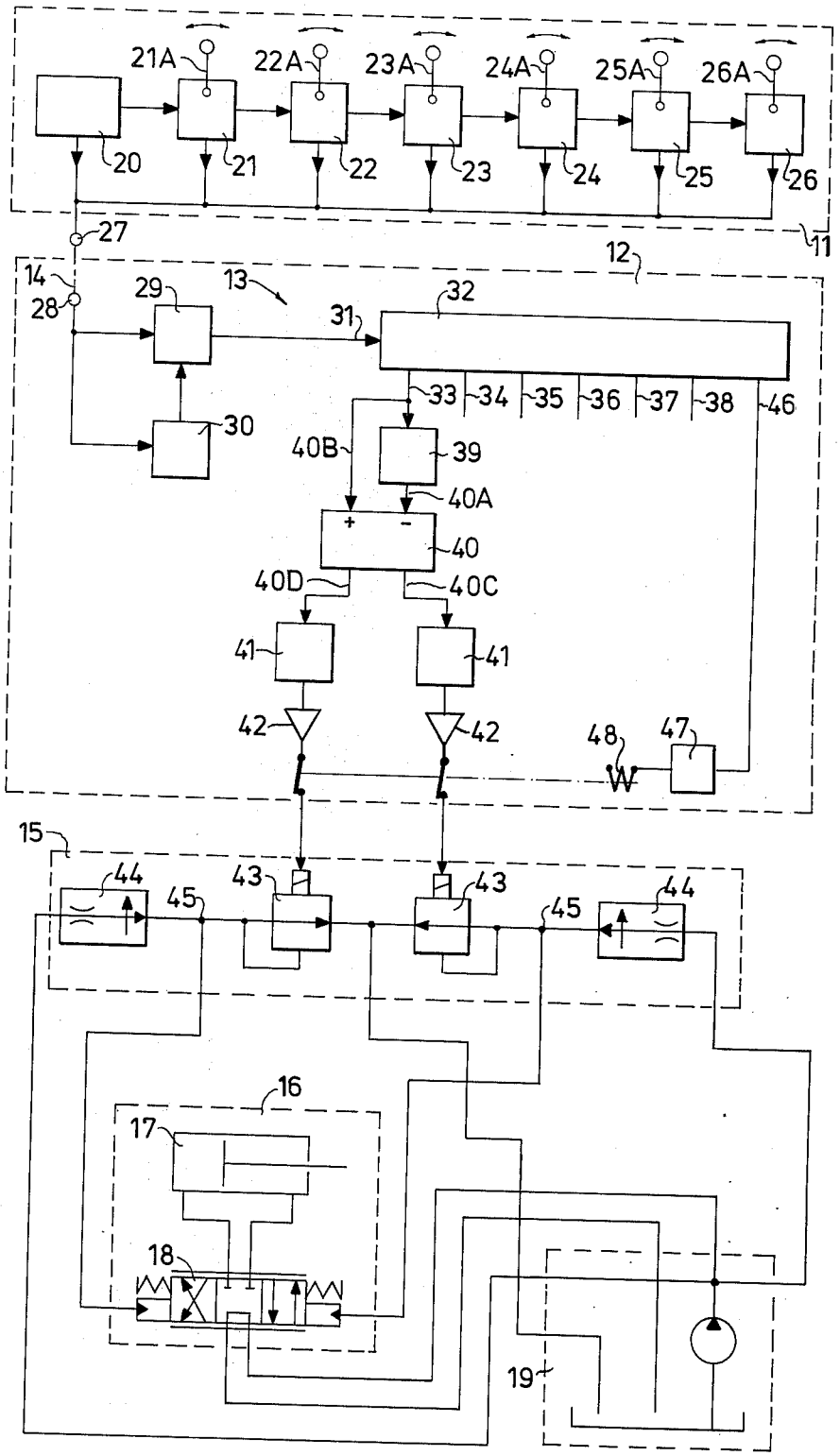
21A
22A
23A
24A
25A
26A
20
21
22
23
24
25
26
27
11
12
14
28
29
13
31
32
33
34
35
36
37
38
46
30
40B
39
40A
+
-
40
40D
40C
41
41
42
42
48
47
15
44
45
43
43
45
44
16
17
18
19

CONTROL SYSTEM

BACKGROUND OF THE INVENTION

This invention relates to a system for the proportional electrohydraulic remote positioning of a plurality of hydraulic control valves.

In the use of hydraulically operated working machines, especially load-handling apparatus, such as vehicle-mounted cranes of the type finding use in mechanized lumbering, it is often desirable to be able to effect the control by means of a portable control unit, that is, from a location that can be chosen according to need in each case. Various embodiments of systems permitting such control are known.

In a known type of system of this kind, the entire hydraulic equipment is disposed on the working machine and connected to a control box through an electric cable. The hydraulic equipment comprises a plurality of proportional control valves in the form of directional control valves for the distribution of hydraulic liquid to the working cylinders, each such control valve be operated by a hydraulic positioner and an electrohydraulic converter connected to the positioner.

The positioner commonly is a double-acting hydraulic cylinder and the converter is an electromagnetically operated servo valve device. This servo valve device is supplied with an electric control signal set at the control box and, depending on the direction or sign of this signal, delivers hydraulic liquid to either of the two compartments of the positioner cylinder until the pressure in that compartment has reached a value proportional to the magnitude of the control signal, namely, until the piston of the positioner cylinder has displaced a spring-centered valve spool of the control valve a distance proportional to the magnitude of the control signal.

The control box includes a control signal transmitter having lever-operated potentiometers which are associated with respective ones of the control valves to be proportionately positioned. Each potentiometer is connected to a pair of solenoids of the converter of the associated control valve such that, depending on the direction of the deflection of the potentiometer lever, one or the other of the two solenoids is supplied with an electric control signal proportional to the magnitude of the lever deflection, which control signal the converter then translates into a proportional hydraulic positioning signal for the positioner.

Since the hydraulic equipment may comprise several control valves — six control valves are common — and since each control valve requires two conductors in the electric cable between the working machine and the control box (these conductors have to be capable of passing a current of a few hundred milliamperes), the cable is expensive and, above all, heavy and thus difficult to handle. This disadvantage is particularly apparent when the working machine is used in forests, since the cable then tends to get caught in scrub, low bushes or tree-stumps. Another disadvantage of systems of the known type is that because of the friction of the valve spools, the remote positioning of these spools cannot be made free from hysteresis, unless special steps are taken.

SUMMARY OF THE INVENTION

These and other disadvantages are avoided in the system according to the invention. As will become apparent in more detail from the following description, the system according to the invention requires only three conductors between the machine and the control box, regardless of the number of control valves to be positioned. In addition to a common ground conductor, it is sufficient to have a single conductor for the transmission of the control signals from the control box to the working machine and another conductor for the current supply to the control box. Moreover, none of the conductors has to carry more than very small currents, and the conductor cross-sectional area thus can be very small. If the control box has a current supply of its own, it is also possible to transmit the control signals from the control box to the machine through a radio link which may be simple and inexpensive and yet provide an accurate and reliable transmission.

DETAILED DESCRIPTION OF THE DRAWING

The invention will be described in more detail hereinafter with reference to the accompanying drawing which shows a block diagram of one embodiment.

The illustrated system is intended for the remote control of, for example, a hydraulic crane or other working machine having six control valves to be proportionately positioned in two directions each and independently of each other. With the exception mentioned below, the entire system is made up of well-known units and for that reason a detailed description of the structure of the individual units is deemed unnecessary.

The main units of the system, which are surrounded by an enclosure of broken lines in the drawing, comprise a signal transmitter 11 intended to be hand-held or carried by an operator remotely from the machine, although it is also possible to have it mounted on the working machine proper; a transmission unit 12 uncluding a signal receiver 13 disposed on the machine and having 12 signal outputs arranged in pairs (only one pair is shown) and also including a cable 14 between the signal transducer and the signal receiver; an electrohydraulic converter assembly 15 for each pair of signal outputs of the receiver; six actuator units 16 (only one is shown) connected to respective ones of the converters, each actuator unit including a double-acting hyraulic cylinder 17 and a control valve (directional control valve) in the form of a hydraulically operated proportional four-way spool valve 18; and finally a pump unit 19 common to all actuator units and converters and having the usual required relief and reduction valves (not shown).

The signal transmitter 11 automatically and repetitively produces a pulse group comprising seven pulses. The repetition rate of the pulse groups is not critical but it will be assumed here that the repetition rate is 50 Hz; as will become apparent as the description proceeds, a frequency of that order of magnitude is advantageous. Each pulse group commences with an initial pulse which is followed by six successive pulses termed control pulses. The total duration of each pulse group is considerably shorter than the time spacing of successive initial pulses (which is 20 milliseconds at 50 Hz); in this case, with a repetition rate of 50 Hz, the nominal time spacing of like portions of each control pulse and the next preceding pulse of the pulse group (either the initial pulse or the next preceding control pulse) is 1.5 ms. The pulses are so-called spike pulses and are of the same magnitude.

The initial pulses are produced by an astable multivibrator 20, and the six control pulses are produced by six cascade-connected monostable circuits 21–26. The astable multivibrator and all monostable circuits have a common output 27 connected to the cable 14, of which only a single conductor for the pulse transmission to the receiver 13 is shown (in addition to this conductor the cable has a conductor for the current supply and a common ground conductor). When it delivers the initial pulse to the output 27, the astable multivibrator 20 also triggers the first monostable circuit 21 which, after a variable delay time, produces the first control pulse and delivers it to the output 27. The first monostable circuit 21 then produces the second control pulse and triggers the second monostable circuit 22, which in turn produces the third control pulse and triggers the third monostable circuit 23, and so on, until the complete pulse group has been produced.

By means of an operating lever 21A–26A the operator can infinitely vary the delay time of each monostable circuit 21–26 between predetermined limits. The operating lever is mechanically coupled with the movable contact of a potentiometer in the associated monostable circuit and spring-biassed to a neutral position in which the delay time is 1.5 ms, and deflection of the operating lever in one direction or the other from the neutral position increases or decreases the delay time by up to 0.5 ms, depending on the direction and magnitude of the deflection. Accordingly, the total duration of the pulse group may vary from 6 to 12 ms, and the last control pulse is thus followed by a pulse-free interval of 8 to 14 ms.

The signal receiver 13 has an input 28 connected to the cable 14. The pulses from the signal transmitter 11 are passed from the input 28 by way of a gate circuit 29 controlled by a resetting circuit 30 to the input 31 of a pulse counter or decoder 32 having six outputs 33–38, herein termed control outputs, associated with respective ones of the six control valves 18, and a seventh output 46, hereinafter termed inhibit output, which is activated only if the received pulse group comprises more than the seven pulses making up a correct pulse group. The decoder 32 is basically a counter having seven cascaded stages and is constructed such that it delivers, in response to the reception of each correct pulse group, six positive signals appearing in succession on respective ones of the six control outputs 33–38, the signal delivered to the first control output 33 being of a duration equal to the time spacing between the first control pulse and the initial pulse, the signal delivered to the second control output 34 being of a duration equal to the time spacing between the second control pulse and the first control pulse, and so on. A few milliseconds after the last pulse of each correct pulse group has appeared on the input 28, the resetting circuit 30 becomes operative to reset the decoder 32 through the gate circuit 29. The pulse-free interval after the pulse group thus serves to make the resetting possible.

Each control output 33–38 of the decoder is connected to an electric and hydraulic circuit arrangement which is similar to that connected to the first control output 33 and which includes one of the control valves 18, but in the interest of clarity the circuit arrangements connected to the other control outputs 34–38 are omitted from the drawing.

The positive output signal on the control output 33 is passed to a monostable circuit 39, which is thereby triggered to deliver an undelayed negative signal of a duration of 1.5 ms to a first input 40A of a comparator 40, and is also passed directly to a second input 40B of the comparator, which has two separate outputs 40C and 40D. If the difference between the signals appearing on the inputs is positive, that is, if the input signal appearing on the first input 40A is of shorter duration than the signal appearing on the second input 40B, the comparator delivers to the output 40D an output signal of a predetermined magnitude and a duration equal to the difference between the durations of the input signals, and if the difference is negative, the comparator delivers to the output 40C an output signal of the same magnitude and a duration equal to the difference between the durations of the input signals. It follows from the foregoing that the output signal can never have a duration longer than 0.5 ms.

The comparator 40 comprises two parallel channels, each having an integrator and a Schmitt trigger connected to the output of the integrator. One channel responds to negative input signals and the other channel responds to positive input signals. Since the signals supplied to the two inputs 40A, 40B from respectively the monostable circuit 39 and the control output 33 are of opposed polarities, commence simultaneously and are of the same magnitude, they cancel each other until the signal of the shortest duration disappears, and depending on whether the signal supplied to the input 40B is shorter or longer than 1.5 ms, either the channel connected to the input 40A or the channel connected to the input 40B will respond to the remainder of the signal of the longest duration.

The output signal of the comparator is extended in a pulse stretcher 41, e.g. to a duration 20 times the duration of the unextended output signal, and amplified in an amplifier 42 whereupon it is supplied to the energization winding of an electrohydraulic servo-pressure valve 43. This valve, in combination with a so-called pressure-compensated flow control or fixed-flow valve 44 (a valve passing a fixed volumetric flow rate regardless of pressure variations at its inlet and outlet and regardless of the viscosity of the hydraulic liquid) and an intermediate outlet 45, forms a servo valve of the kind constituting the subject matter of my copending patent application Ser. No. 560,930 entitled "Valve device" filed concurrently herewith and incorporated herein by reference.

As explained in more detail in the just-mentioned patent application, the servo valve 43, 44, 45 translates the electric input signal received from the amplifier 42 into a hydraulic positioning signal the pressure magnitude of which is proportional to the amperages of the input signal, if this amperage is constant. In this case, where the input signal is a sequence of unipolar pulses having a variable pulse duty factor, or, in other words, where the amperage of the input signal varies periodically at the rate of 50 Hz, the pressure magnitude of the hydraulic positioning signal is proportional to a modified or reduced value of the amperage of the input signal, namely, proportional to the pulse duty factor of the input signal. As is apparent from the foregoing description, the pulse duty factor is proportional to the magnitude of the deflection of the operating lever 21A of the signal transmitter, a proportionality factor being the ratio of the duration of the extended pulses from the pulse stretcher 41 to the duration of the output signals from the comparator 40.

The hydraulic positioning signal appears at the outlet 45 and is supplied to a positioner cylinder for the spool of the control valve 18 and this spool is consequently displaced a distance corresponding to the pressure magnitude of the positioning signal so that the piston of the working cylinder 17 is displaced at a corresponding speed. Since the volumetric flow rate of the flow through the fixedflow valve 44 is always constant as long as the pressure drop across this valve exceeds a predetermined relatively low value, a good proportionality of the magnitude of deflection of the operating lever to the position of the piston of the control valve positioner cylinder and thus the speed of displacement of the spool of the control valve is obtained.

Since the servo-pressure setting valve is supplied with a sequence of pulses, pulsations are produced in the liquid supplied to the positioner cylinder. These pulsations contribute to a considerable reduction or to an elimination of the troublesome hysteresis which is otherwise normally caused by the friction of the positioner cylinder piston and the control valve spool. The effect of these pulsations is augmented if the housing of the pressure setting valve is mounted on the positioner cylinder; the mechanical vibrations produced in the pressure setting valve by the input signal are then propagated to the positioner cylinder and the control valve housing. The effect of the vibrations and pulsations can be varied by changing the repetition rate of the pulse groups.

The practically hysteresis-free positioning of the valve spool produces an extremely good accordance of the position of the operating lever and the position of the valve spool. The combination of servo-pressure valves of the above-described type with fixed-flow valves in the electrohydraulic converter assemblies 15 also ensures that the proportionality is maintained even if more than one of the control valves are operated simultaneously, even though all converter assemblies are supplied with liquid from the same pump.

The inhibit output 46 is the output of the seventh, final stage of the seven cascaded stages of the decoder 32 and is connected through a control circuit 47 to a relay 48 operative upon activation to inhibit all amplifiers 42 from delivering an output signal to the pressure setting valves 43. In the interest of simplicity the relay 48 is shown as an electromechanical relay which upon activation blocks the connection between the output of the amplifiers 42 and the pressure setting valves 43, but in practice the inhibition or blocking of the amplifiers may be provided for in other ways. For example, the relay 48 may be an electronic switch adapted upon activation to disconnect the drive voltage of the amplifiers.

The inhibit output 46 serves to prevent an uncontrolled positioning of the control valves 18 if repeated spurious pulses should appear on the input 31 of the decoder 32. Such spurious pulses may appear particularly if the transmission of signals between the signal transmitter 11 and the signal receiver 13 is effected through a radio link and may be caused by communication radio transmitters or by radio transmitters of other remote control systems. If such spurious pulses appear, they almost always manifest themselves such that one or more of the pulse groups supplied to the input of the decoder 32 comprise pulses in addition to the seven pulses repetitively produced by the signal transmitter 11. If a pulse group comprises more than seven pulses, the inhibit output 46 will also be supplied with a signal, which is fed to the control circuit 47. This control circuit is constructed such that it delivers an activation signal to the relay 48 only after it has received a predetermined number of signals from the inhibit output 46 in the course of an interval of predetermined duration. Accordingly, occasional incorrect pulse groups do not cause suppression of the signals from the amplifiers 42.

Naturally, the applicability of the remote control system according to the invention is not limited to the remote positioning of centered control valves, that is, valves which can be positioned in either direction from a central neutral position. Moreover, the system is also applicable to the remote positioning of objects other than hydraulic control valves.

What is claimed is:

1. A system for remote proportional positioning of a plurality of hydraulic directional control valves, comprising a. a signal transmitter having a plurality of manual operating members, a pulse generator for repetitively producing a pulse group comprising an initial pulse and a plurality of control pulses, one for each operating member, following in time-spaced succession after the initial pulse, and means for changing the time spacing of each control pulse from the next preceding one of the pulses of the pulse group in accordance with the position of the associated operating member, b. a plurality of electrohydraulic converters associated with respective ones of the operating members and adapted to be connected to an associated one of the control valves to be positioned, each such converter including means for producing a hydraulic positioning signal proportional to an electric input signal, and c. a transmission unit for the transmission of the pulse groups from the signal transmitter and for deriving from the pulse group an electric input signal for each converter, including a decoder having an input for the pulse groups from the signal transmitter, means for deriving from each control pulse of a received pulse group an electric signal of a predetermined magnitude and of a duration proportional to the time spacing of that control pulse from the next preceding one of the pulses of the pulse group and shorter than the time spacing of two successive pulse groups, and means for feeding this signal as an input signal to the associated converter.

2. A system according to claim 1 in which each converter includes at least one electrohydraulic servo valve device having a fixed-flow valve adapted to be connected to a liquid pressure source, and a servo-pressure valve having an inlet connected to the outlet of the fixed-flow valve and an electromagnetic operating device adapted to receive the input signal from the transmission unit and cause a pressure proportional thereto to be developed in a pressurized-liquid outlet between the outlet of the fixed-flow valve and the inlet of the servo-pressure valve.

3. A system according to claim 1 in which the decoder includes means responsive to a pulse in excess of the pulses constituting the pulse group to produce an inhibit signal on an inhibit output and also includes inhibit means connected to the inhibit output and responsive to the reception of at least one inhibit signal to suppress the feeding of input signals from the transmission unit to the converters.

* * * * *